US008490804B2

(12) United States Patent
Benoit-Gonin et al.

(10) Patent No.: US 8,490,804 B2
(45) Date of Patent: Jul. 23, 2013

(54) CLOSURE WITH MOVABLE TAMPER-EVIDENT MEMBER

(75) Inventors: Claude Benoit-Gonin, Odenas (FR); Philippe Bardet, Gleize (FR)

(73) Assignee: Obrist Closures Switzerland GmbH, Reinach (CH)

( * ) Notice: Subject to any disclaimer, the term of this patent is extended or adjusted under 35 U.S.C. 154(b) by 341 days.

(21) Appl. No.: 12/740,939

(22) PCT Filed: Oct. 30, 2008

(86) PCT No.: PCT/GB2008/003666

§ 371 (c)(1),
(2), (4) Date: Jul. 6, 2010

(87) PCT Pub. No.: WO2009/056829

PCT Pub. Date: May 7, 2009

(65) Prior Publication Data

US 2010/0264145 A1 Oct. 21, 2010

(30) Foreign Application Priority Data

Oct. 31, 2007 (GB) ..... 0721330.9

(51) Int. Cl.
*B65D 55/06* (2006.01)
*B65D 41/46* (2006.01)

(52) U.S. Cl.
USPC ..... 215/225; 215/216; 215/237; 215/251; 215/253; 215/255; 215/305; 215/322; 215/901

(58) Field of Classification Search
USPC ..... 215/209, 216, 225, 237, 251, 253–255, 215/305, 322, 901; 220/254.9, 345.1, 345.2, 220/345.4; 222/560
See application file for complete search history.

(56) References Cited

U.S. PATENT DOCUMENTS

| | | | | |
|---|---|---|---|---|
| 1,798,151 | A | 3/1931 | Fabrice | |
| 2,013,605 | A * | 9/1935 | Greenison | 215/252 |
| 2,073,707 | A * | 3/1937 | Parkin | 222/560 |
| 2,858,054 | A | 10/1958 | Harkrader | |
| 3,348,718 | A | 10/1967 | Musy | |
| 3,412,890 | A | 11/1968 | Rich | |

(Continued)

FOREIGN PATENT DOCUMENTS

| | | |
|---|---|---|
| DE | 809 896 | 8/1951 |
| DE | 809896 C | 8/1951 |

(Continued)

OTHER PUBLICATIONS

JP2003160162A—JPO Machine English Translation.*

(Continued)

*Primary Examiner* — J. Gregory Pickett
*Assistant Examiner* — Ned A Walker
(74) *Attorney, Agent, or Firm* — Alleman Hall McCoy Russell & Tuttle LLP

(57) ABSTRACT

A tamper-evident closure may include a base, a lid, and a tamper-evident member. The tamper-evident member may be irreversibly moveable between a first position in which part of the member is visible prior to initial opening of the closure and a second position in which the part is masked by the lid so as to be partly hidden from view. Upon initial opening of the closure, the tamper-evident member may be moved from the first position to the second position.

17 Claims, 5 Drawing Sheets

U.S. PATENT DOCUMENTS

| | | | | | |
|---|---|---|---|---|---|
| 3,425,578 | A | | 2/1969 | Owens | |
| 3,455,479 | A | | 7/1969 | Wilton | |
| 3,603,470 | A | | 9/1971 | Armour | |
| 3,810,556 | A | | 5/1974 | Coursaut | |
| 3,820,683 | A | | 6/1974 | Jasinski | |
| 3,871,545 | A | | 3/1975 | Bereziat | |
| 3,892,351 | A | | 7/1975 | Johnson et al. | |
| 4,091,949 | A | | 5/1978 | Fowles et al. | |
| 4,119,239 | A | * | 10/1978 | Anderson | 220/324 |
| 4,303,171 | A | | 12/1981 | Schremmer | |
| 4,310,105 | A | | 1/1982 | Gach | |
| 4,531,649 | A | | 7/1985 | Shull | |
| 4,569,464 | A | | 2/1986 | Wassilieff | |
| 4,637,519 | A | | 1/1987 | Dutt et al. | |
| 4,687,112 | A | * | 8/1987 | Swartzbaugh | 215/216 |
| 4,697,719 | A | | 10/1987 | Allen | |
| 4,744,480 | A | | 5/1988 | Luch et al. | |
| 4,752,014 | A | * | 6/1988 | House et al. | 215/216 |
| 4,790,442 | A | | 12/1988 | Gach | |
| 4,838,441 | A | | 6/1989 | Chernack | |
| 4,905,861 | A | * | 3/1990 | Boxall et al. | 220/266 |
| 4,941,592 | A | | 7/1990 | Kitterman | |
| 4,942,970 | A | | 7/1990 | Jay | |
| 4,966,302 | A | * | 10/1990 | Hjordie | 220/268 |
| 5,004,126 | A | | 4/1991 | Klesius | |
| 5,105,959 | A | | 4/1992 | Kinsley | |
| 5,234,124 | A | * | 8/1993 | Buckner et al. | 220/326 |
| 5,332,113 | A | | 7/1994 | Kusler et al. | |
| 5,348,185 | A | * | 9/1994 | Buckner et al. | 220/326 |
| 5,427,260 | A | | 6/1995 | Mueller et al. | |
| 5,445,824 | A | | 8/1995 | Someya | |
| 5,538,154 | A | * | 7/1996 | Von Holdt | 220/277 |
| 5,588,545 | A | | 12/1996 | King et al. | |
| 5,603,422 | A | | 2/1997 | Herrmann | |
| 5,683,016 | A | | 11/1997 | Santagiuliana | |
| 5,819,965 | A | | 10/1998 | King et al. | |
| 5,875,907 | A | * | 3/1999 | Lay | 215/253 |
| 5,875,942 | A | * | 3/1999 | Ohmi et al. | 222/556 |
| 5,960,979 | A | * | 10/1999 | Van Den Brink et al. | 220/266 |
| 5,979,681 | A | * | 11/1999 | PatrickJean-Luc et al. | 215/216 |
| 6,000,568 | A | | 12/1999 | Verter | |
| 6,036,036 | A | | 3/2000 | Bilani et al. | |
| 6,095,375 | A | | 8/2000 | Adams et al. | |
| 6,269,986 | B1 | | 8/2001 | Gross | |
| 6,318,585 | B1 | * | 11/2001 | Asagiri et al. | 220/788 |
| 6,328,355 | B1 | * | 12/2001 | Bortz | 292/307 R |
| 6,405,885 | B1 | * | 6/2002 | Elliott | 215/237 |
| 6,484,879 | B2 | | 11/2002 | Desmarais et al. | |
| 6,631,820 | B2 | * | 10/2003 | Harrold et al. | 215/237 |
| 6,644,487 | B2 | * | 11/2003 | Smith et al. | 215/235 |
| 6,683,038 | B2 | | 1/2004 | Forth et al. | |
| 6,685,046 | B2 | | 2/2004 | Ogino | |
| 6,688,501 | B2 | | 2/2004 | DeGroot et al. | |
| 6,727,215 | B2 | | 4/2004 | Roberts et al. | |
| 6,848,603 | B2 | * | 2/2005 | Gaiser et al. | 222/153.1 |
| 6,866,162 | B2 | * | 3/2005 | Morris, Sr. | 220/288 |
| 6,866,164 | B2 | | 3/2005 | Branson et al. | |
| 6,877,631 | B1 | * | 4/2005 | Thompson et al. | 220/266 |
| 6,880,729 | B2 | | 4/2005 | Stull et al. | |
| 6,976,607 | B2 | * | 12/2005 | Benoit-Gonin et al. | 222/153.06 |
| 7,044,317 | B2 | * | 5/2006 | Smith et al. | 215/235 |
| 7,077,294 | B2 | | 7/2006 | Nusbaum et al. | |
| 7,121,419 | B2 | | 10/2006 | Ferry et al. | |
| 7,125,828 | B2 | | 10/2006 | Catlin et al. | |
| 7,156,247 | B2 | * | 1/2007 | Laburu | 215/235 |
| 7,159,733 | B2 | * | 1/2007 | Pickles | 220/324 |
| 7,204,383 | B2 | | 4/2007 | Hsu | |
| 7,374,053 | B2 | * | 5/2008 | Herald et al. | 215/237 |
| 7,438,198 | B2 | * | 10/2008 | Pickles | 220/324 |
| 7,731,049 | B2 | * | 6/2010 | Dengel et al. | 220/284 |
| 7,735,665 | B2 | * | 6/2010 | Robinson | 215/237 |
| 2002/0079282 | A1 | * | 6/2002 | Harrold et al. | 215/237 |
| 2002/0125249 | A1 | | 9/2002 | Baird-Smith et al. | |
| 2003/0034323 | A1 | * | 2/2003 | Smith et al. | 215/235 |
| 2003/0062369 | A1 | * | 4/2003 | Hierzer et al. | 220/259.1 |
| 2004/0026420 | A1 | | 2/2004 | Smith | |
| 2004/0050849 | A1 | * | 3/2004 | Pickles | 220/324 |
| 2004/0069806 | A1 | * | 4/2004 | Benoit-Gonin et al. | 222/153.06 |
| 2004/0143505 | A1 | | 7/2004 | Kovach | |
| 2004/0188374 | A1 | * | 9/2004 | Ochoa Laburu | 215/235 |
| 2005/0035158 | A1 | * | 2/2005 | Benoit-Gonin et al. | 222/564 |
| 2005/0133475 | A1 | | 6/2005 | Goto et al. | |
| 2005/0173368 | A1 | * | 8/2005 | Nusbaum et al. | 215/237 |
| 2005/0205607 | A1 | | 9/2005 | Hierzer et al. | |
| 2005/0279727 | A1 | * | 12/2005 | Graswald et al. | 215/237 |
| 2006/0006130 | A1 | | 1/2006 | Romer et al. | |
| 2006/0011573 | A1 | | 1/2006 | Herald et al. | |
| 2006/0011631 | A1 | * | 1/2006 | Dengel et al. | 220/270 |
| 2006/0043052 | A1 | | 3/2006 | Lin | |
| 2006/0077062 | A1 | | 4/2006 | Andrechak | |
| 2006/0124646 | A1 | | 6/2006 | Guglielmini et al. | |
| 2006/0186077 | A1 | * | 8/2006 | Robinson | 215/237 |
| 2006/0186078 | A1 | * | 8/2006 | Ziegenhorn | 215/237 |
| 2006/0201947 | A1 | * | 9/2006 | Pickles | 220/326 |
| 2008/0237236 | A1 | * | 10/2008 | Tanner et al. | 220/320 |
| 2008/0277613 | A1 | | 11/2008 | Ramsey et al. | |

FOREIGN PATENT DOCUMENTS

| | | | |
|---|---|---|---|
| DE | 861 666 | | 1/1953 |
| DE | 861666 | C | 1/1953 |
| DE | 85 35 205 | U1 | 2/1986 |
| DE | 8535205 | U1 | 2/1986 |
| DE | 3 605 963 | A1 | 8/1987 |
| DE | 3605963 | A1 | 8/1987 |
| DE | 20019797 | U1 | 4/2001 |
| DE | 200 19 797 | U1 | 5/2001 |
| EP | 0 127 943 | A1 | 12/1984 |
| EP | 0 132 792 | A1 | 2/1985 |
| EP | 0132792 | A1 | 2/1985 |
| EP | 0 179 498 | A1 | 4/1986 |
| EP | 0179498 | A1 | 4/1986 |
| EP | 0 236 136 | A2 | 9/1987 |
| EP | 0 306 670 | A2 | 3/1989 |
| EP | 0306670 | A2 | 3/1989 |
| EP | 0 337 568 | A2 | 10/1989 |
| EP | 0 414 462 | A2 | 2/1991 |
| EP | 0425391 | A1 | 5/1991 |
| EP | 0 593 952 | A1 | 9/1993 |
| EP | 0593952 | A1 | 4/1994 |
| EP | 0 619 243 | A1 | 10/1994 |
| EP | 0619243 | A1 | 10/1994 |
| EP | 0 688 723 | A1 | 12/1995 |
| EP | 1 101 707 | A1 | 5/2001 |
| EP | 1174359 | A1 | 1/2002 |
| EP | 1 266 839 | A | 12/2002 |
| EP | 1 266 839 | A2 | 12/2002 |
| EP | 1 283 175 | A2 | 2/2003 |
| EP | 1283175 | A2 | 2/2003 |
| EP | 1 161 382 | B1 | 9/2003 |
| EP | 2005/053085 | | 6/2004 |
| EP | 0 425 391 71 | | 6/2005 |
| EP | 1 694 576 | B1 | 2/2008 |
| EP | 1 786 698 | B1 | 9/2008 |
| EP | 1 663 809 | B1 | 10/2008 |
| FR | 2 439 139 | A | 5/1980 |
| FR | 2439139 | A1 | 5/1980 |
| FR | 2 567 106 | A | 1/1986 |
| FR | 2567106 | A1 | 1/1986 |
| FR | 2 591 571 | A | 6/1987 |
| FR | 2591571 | A1 | 6/1987 |
| GB | 1 298 084 | A | 11/1972 |
| GB | 1 473 482 | A | 5/1977 |
| GB | 1484517 | | 9/1977 |
| GB | 2 123 392 | A | 2/1984 |
| GB | 2 136 782 | A | 9/1984 |
| GB | 2 148 235 | A | 5/1985 |
| GB | 2 158 424 | A | 11/1985 |
| GB | 2 172 803 | A | 10/1986 |
| GB | 2 222 821 | A | 3/1990 |
| GB | 2 264 110 | B | 8/1993 |
| GB | 2 311 283 | A | 9/1997 |
| GB | 2 355 269 | A | 4/2001 |
| GB | 2 356 842 | A | 6/2001 |
| GB | 2 375 516 | A | 11/2002 |
| GB | 2 430 667 | A | 4/2007 |
| GB | 2430667 | A | 4/2007 |
| GB | 2 415 426 | A | 5/2007 |

| | | | |
|---|---|---|---|
| GB | 2 432 153 | A | 11/2007 |
| JP | 10338251 | A | 12/1998 |
| JP | 10 338251 | A | 3/1999 |
| JP | 2000/229651 | | 8/2000 |
| JP | 2003/160162 | A | 11/2001 |
| JP | 2003/160162 | | 6/2003 |
| WO | WO 94/07470 | A1 | 4/1994 |
| WO | WO 99/57031 | A1 | 11/1999 |
| WO | WO 00/26878 | A1 | 5/2000 |
| WO | 0066451 | A1 | 11/2000 |
| WO | WO 00/66451 | A1 | 11/2000 |
| WO | WO 01/36290 | A1 | 5/2001 |
| WO | WO 01/83668 | A1 | 11/2001 |
| WO | WO 02/44047 | A1 | 6/2002 |
| WO | WO 02/085730 | | 10/2002 |
| WO | WO 02/096771 | A1 | 12/2002 |
| WO | 03016162 | A1 | 2/2003 |
| WO | WO 03/016162 | A1 | 2/2003 |
| WO | WO 03/016165 | A1 | 2/2003 |
| WO | WO 2004/011347 | | 2/2004 |
| WO | WO 2005/024745 | A2 | 3/2005 |
| WO | 2005049443 | A1 | 6/2005 |
| WO | WO 2005/049443 | | 6/2005 |
| WO | 2006003168 | A1 | 1/2006 |
| WO | WO 2006/000532 | A1 | 1/2006 |
| WO | WO 2006/003168 | | 1/2006 |
| WO | WO 2006/008285 | | 1/2006 |
| WO | 2006020059 | A2 | 2/2006 |
| WO | WO 2006/020059 | A2 | 2/2006 |
| WO | WO 2006/117505 | | 11/2006 |
| WO | 2007045054 | A1 | 4/2007 |
| WO | WO 2007/125292 | A2 | 11/2007 |
| WO | WO 2009/056829 | A1 | 5/2009 |

OTHER PUBLICATIONS

Serial No. PCT/EP2005/053441, completed Dec. 1, 2005, International Search Report and Written Opinion of the International Searching Authority, 5 pages.

Serial No. PCT/EP2003/07798, mailed Oct. 15, 2004, International Search Report and Written Opinion of the International Searching Authority, 5 pages.

UK Application No. GB 0721330.9; Search Report and Written Opinion dated Feb. 27, 2008; 4 pages.

EP 1 663 809 B1 Documents Related to Opposition (8 pages).

Ser No. PCT/GB2008/03666, International Search Report and Written Opinion, Feb. 24, 2009 (13 pages).

* cited by examiner

CLOSURE WITH MOVABLE TAMPER-EVIDENT MEMBER

CROSS REFERENCE TO RELATED APPLICATIONS

This application claims priority from UK Patent Application Serial No. 0721330.9, filed Oct. 31, 2007, and is directly related to International Patent Application Serial No. PCT/GB2008/003666, filed Oct. 30, 2008, the entire contents of each of which is herein incorporated fully by reference.

FIGURE FOR PUBLICATION

FIG. 2.

BACKGROUND OF THE INVENTION

1. Field of the Invention

The present invention relates to a closure for a container. More specifically, the present invention relates to a closure which can provide some indication that the closure has been opened at least once.

2. Description of the Related Art

The related art involves container closures with tamper-evident drop bands which are released from the open end of a closure side wall upon first opening. Although drop bands provide some indication that the closure has been opened, because they are physically separated there is no clear indication of opening on the remaining part of the closure. It is also known to provide tear-off bands which are removed from a closure body upon first opening.

What is not appreciated by the prior art is that the tear-off bands of the closure body present a litter problem and a potential choking hazard because they are generally small tabs which are separated from the closure body.

Accordingly, there is a need for an improved tamper evident closure that overcomes the problems identified hereinabove.

ASPECTS AND SUMMARY OF THE INVENTION

An aspect of the present invention is to provide address the problems with known tamper-evident closures.

Another aspect of the present invention is to provide a tamper-evident closure comprising a base, a lid and a tamper-evident member irreversibly movable between a first position in which part of the member is visible prior to initial opening of the closure and a second position in which the part of the member is now masked by the lid so as to be at least partly hidden from view, the tamper-evident member being moved from the first position to the second position upon initial opening of the closure.

The closure may include a hinge for allowing the lid to move with respect to the base between an open position and a closed position.

The base and lid may be integrally hinged to one another in that they are manufactured as one piece. For instance, the closure may be manufactured from plastics and the base and lid may be molded in one, connected together via the hinge. The hinge may be a snap type hinge and may include at least one strap.

The closure may include first retaining means for retaining the tamper-evident member in the first position. The first retaining means may comprise at least one frangible bridge connecting the tamper-evident member to the base and/or lid.

The closure may include second retaining means for retaining the tamper-evident member in the second position. The second retaining means may comprise a first projection on the lid and a first recess in the tamper-evident member. Alternatively, the second retaining means may comprise a first projection on the tamper-evident member and a first recess in the lid.

The closure may further include third retaining means for retaining the lid in an initially closed position. The third retaining means may comprise a second projection on the lid and a second recess in the tamper-evident member. Alternatively, the third retaining means may comprise a second projection on the tamper-evident member and a second recess in the lid.

In one embodiment of the present invention, the first and second projections described above may be one and the same.

The tamper-evident member may include a grasping portion for aiding the movement of the tamper-evident member from the first position to the second position. This grasping portion may project radially outwards from the perimeter of the lid such that it is easily grasped by a user.

A dispensing member may be included in the closure. This dispensing member may be substantially hidden from view by the tamper-evident member with the tamper-evident member in the first position. At least part of the dispensing member may be revealed with the tamper-evident member in the second position.

The dispensing member may be a spout. The dispensing member may be a different colour and/or texture from the lid and/or base to allow it to be more easily differentiated from the lid and/or base.

In use, a user may grasp the grasping portion and move the tamper-evident member from the first position to the second position thus breaking the frangible bridge connecting the tamper-evident member to the base. hi one embodiment, the user may grasp the grasping portion and lift or push it upwardly away from the base in an attempt to open the lid in a manner which is common to typical flip-top closures. The act of lifting or applying force to the grasping portion may move it from the first position to the second position. Continued application of this force may then rotate the lid about the hinge such that it opens the closure. When the closure is returned to its closed position, by movement of the lid from its open position to its closed position adjacent to the base, the tamper-evident member may remain in the second position thus providing evidence that the closure has been initially opened. This evidence is enhanced by the grasping portion projecting from the lid having been moved from its initial position to its subsequent position. Further, enhancement may be provided by the revealing of at least a part of the dispensing member which is initially masked by the tamper-evident member. If the dispensing member is a different color from the lid and/or base then it may be more clearly evident to a user that the closure has been initially opened at least once and then re-closed.

The dispensing member may be a separate member from the lid and/or base. For instance, it may be molded separately, as opposed to being integral with the lid and/or base. The dispensing member may then be assembled with the lid and/or base. The dispensing member may be a spout for drinking from directly or for pouring from. Alternatively, the dispensing member may be integral with the lid or base.

The tamper-evident member may initially be in an unprimed state on molding and with the lid in the as-molded open position. Following initial closing of the lid the tamper evident member may then have a primed state in that the second projection and recess are inter-engaged.

The closure may include further tamper-evidence means in the form of a ring provided at the lower end of the base. This ring may fit over a neck finish of an associated container so that the base and lid combination may not be unscrewed, or otherwise removed, from the container without breaking the connection between this ring and the base. The ring may be connected to the base of the closure by the means of frangible bridges as is well known in this technical field.

In another embodiment of the present invention, the lid, base and hinge are molded unitarily.

In another embodiment of the present invention, the lid includes an aperture through which the tamper-evident member is visible with the tamper-evident member in the second position. It is possible that the tamper-evident member is not visible through the lid aperture with the tamper-evident member in the first position.

The lid aperture may be provided in the top of the lid.

In another aspect, the invention provides a tamper-evident closure comprising a base, a lid and a tamper-evident member irreversibly moveable between a first position in which part of the member is masked by the lid prior to initial opening of the closure and a second position in which the said part is visible via an opening in the lid, the tamper-evident member being moved from the first position to the second position upon initial opening of the closure.

The various embodiments and features discussed above with regard to the first aspect of the invention may also apply to the second aspect of the invention.

The closure may be formed from any suitable material, such as plastics or metallic material. Different components of the closure may be formed from different materials.

The above, and other aspects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
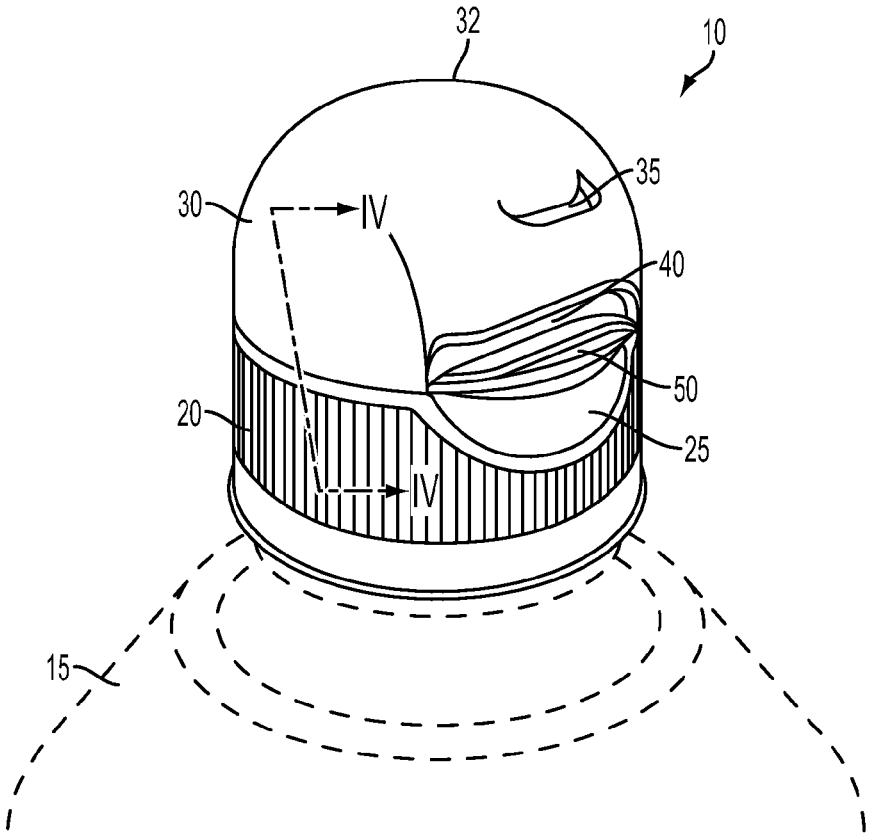
FIG. 1 is a perspective view of a closure formed according to a first embodiment of the present invention shown in an open state.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, and below may be used with respect to the drawings. These and similar directional terms should not be construed to limit the scope of the invention in any manner. The words "connect," "couple," and similar terms with their inflectional morphemes do not necessarily denote direct and immediate connections, but also include connections through mediate elements or devices.

Referring first to FIG. 1 there is shown a tamper-evident closure generally indicated 10. The closure 10 is shown attached to the neck of a container 15. The closure 10 comprises a base 20 and a lid 30 which together comprise a closure body. The lid 30 is connected to the base 20 by a hinge 100 (refer to FIG. 3).

The base 20 comprises a cylindrical skirt which is open at both ends. At the end of the skirt adjacent the lid 30 a flange, or deck 22 (refer to FIG. 3) extends radially inward.

The lid 30 comprises an upturned cup-shape body having a top plate 32 and a side skirt depending from the periphery of the top plate. The skirt of the lid 30 is coaxial and concentric with the skirt of the base 20 such that in the closed position the side walls of the base 20 and the lid 30 are contiguous.

The base 20 is provided with a recess 25 which is located on the other side of the circumference of the base 20 from the hinge 100.

The closure 10 includes a tamper-evident member 40 which is located within the lid 30. This tamper-evident member 40 includes a grasping portion 50 which projects radially outward from the perimeter of the lid 30 and above the recess 25 provided in the skirt 20. The grasping portion 50 is more readily gripped by a user due to the proximity of the recess 25 in the base 20 which reduces the diameter of the closure at this point underneath the grasping portion 50.

The lid 30 also includes an aperture or opening 35 which is provided axially above the grasping portion 50 and on a shoulder of the lid 30 between the top plate 32 and the base 20.

Figure 2:
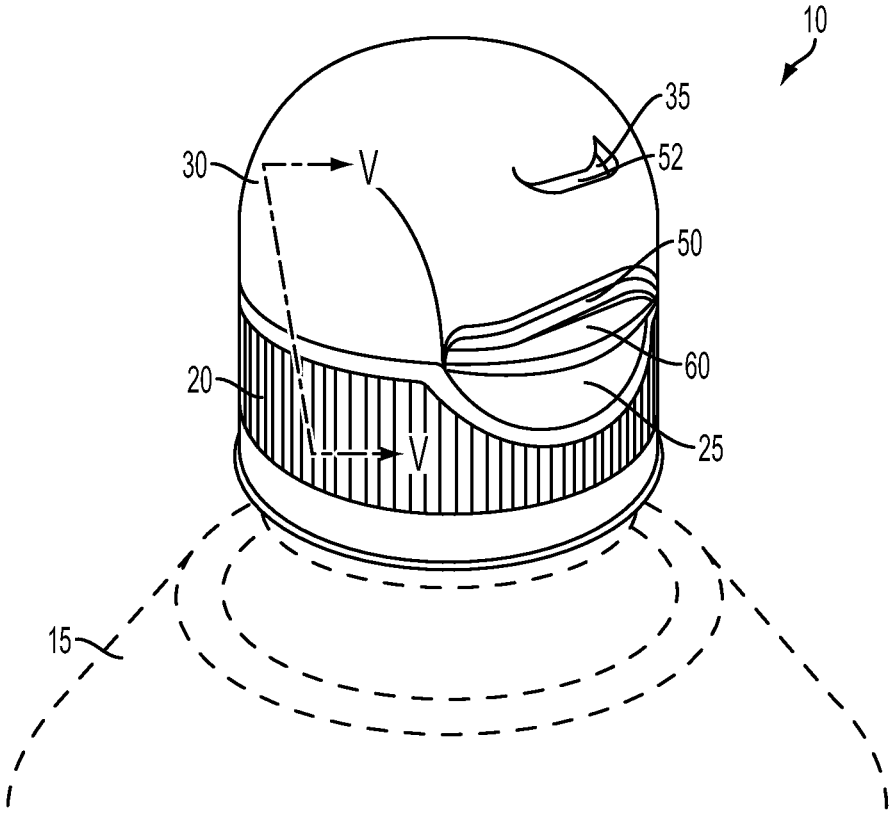
FIG. 2 is a perspective view of the closure of FIG. 1 having been opened and re-closed.

In use, a user may grasp the grasping portion 50 and push it axially upwards and away from the base 20 in order to open the lid 30 in a manner typically associated with flip-top lids. By the application of force on the grasping portion 50, the tamper-evident member 40 is moved upwardly inside the lid 30 as shown in FIG. 2. With the tamper-evident member 40 moved upwardly within the lid 30 a portion 60 of the dispensing member 80 (refer to FIG. 3) is visible through an opening 110 (refer to FIG. 5) which was previously masked by the tamper-evident member 40.

A portion 52 of the tamper-evident member 40 is also visible through the lid aperture 35 in the lid 30 once the tamper-evident member 40 has moved upwardly inside the lid 30.

FIG. 2 shows the closure 10 after having been initially opened and then re-closed. Due to the structure which will be described below the tamper-evident member 40 is irreversibly locked in the upper second position, as shown in FIG. 2, which provides evidence of the closure having been opened at least once. Accordingly, evidence of tampering or having been opened and re-closed is thus provided. If the dispensing member has a different color from the lid and/or base then it is more clearly apparent to a user that the closure has been initially opened and re-closed since the portion 60 of the dispensing member 80 is more clearly visible through the opening 110.

Figure 3:
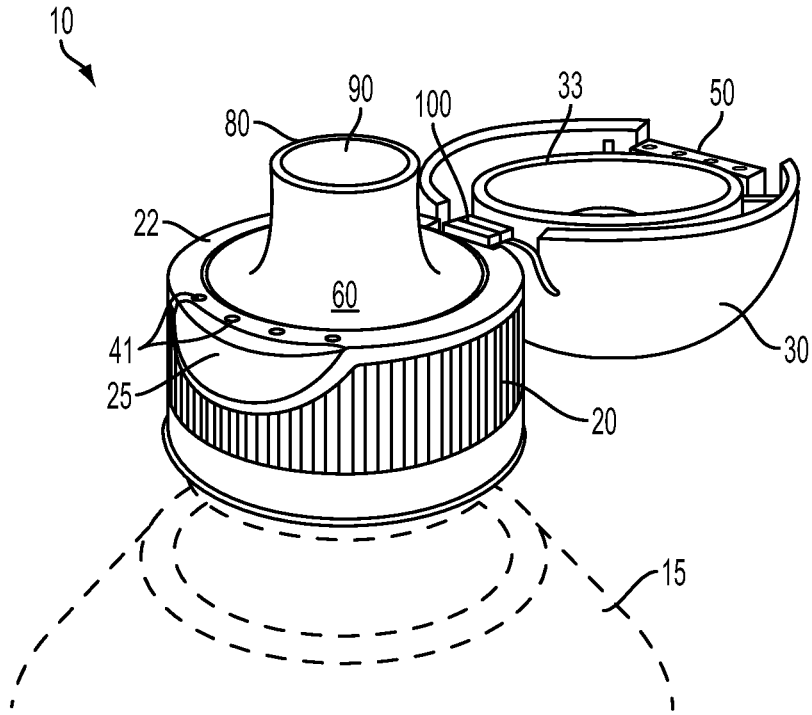
FIG. 3 is a perspective view of the closure of FIGS. 1 and 2 shown in the open position.

With reference to FIG. 3, the lid 30 of the closure 10 is shown in the fully open position having been rotated about the hinge 100. A dispensing member 80 is shown exposed provided in association with the base 20. The dispensing member 80 includes a spout having an orifice 90. The dispensing member 80 is sealed by interaction with a bore seal 33 provided on the underside of the lid 30. This bore seal 33 takes the form of a substantially cylindrical projection which fits around the spout 90 and seals against the dispensing member 80. The tamper-evident member 40 is not visible in this FIG.

3; however, the grasping portion 50 is shown in the second or raised position. Frangible bridges 51 (refer to FIG. 4) have broken on movement of the tamper-evident member 40 to the second position. The remains 41 of the frangible bridges 51 are visible on the deck 22 of the base 20 in the region of the recess 25.

Figure 4:
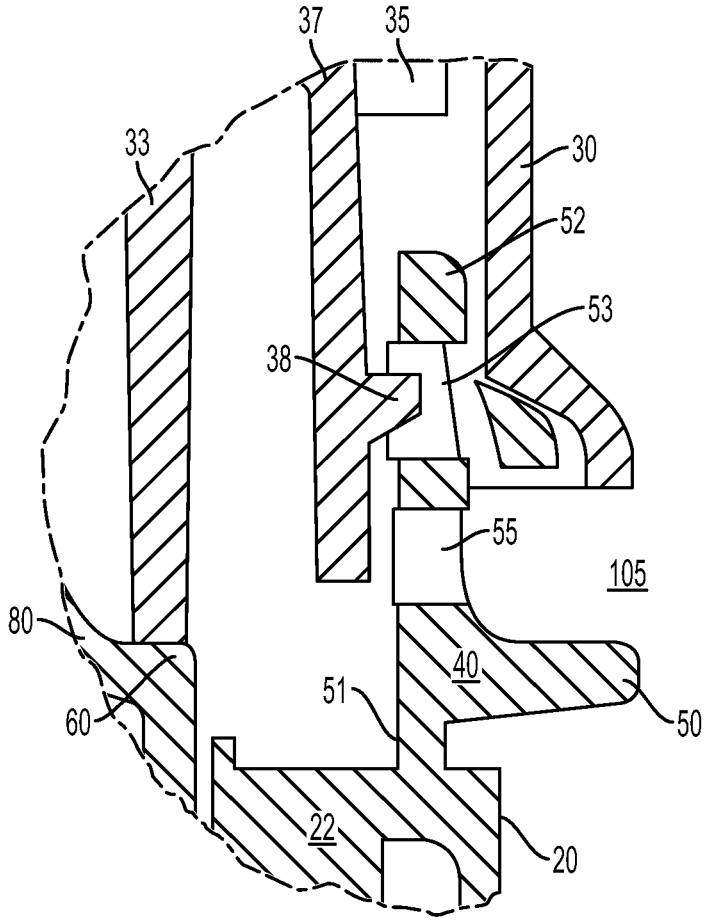
FIG. 4 is an elevational cross-section of part of the closure of FIG. 1.

Referring now to FIG. 4, there is shown a partial cross-section of the closure 10 through the area surrounding and including the tamper-evident member 40. FIG. 4 shows the tamper-evident member 40 in the first or lower position, relative to the lid 30 and the base 20. The grasping portion 50 is spaced from the lid 30 such that an opening 105 provides a "window" or aperture through which the tamper-evident member 40 is visible. The dispensing member 80 and in particular a portion 60 of the dispensing member 80 is not visible through the aperture 105 since the tamper-evident member 40 masks it. The tamper-evident member 40 is connected to the base via at least one frangible bridge 51. The tamper-evident member 40 comprises two recesses 53, 55 provided one axially above the other and above the grasping member 50. The top 52 of the tamper-evident member 40 is axially displaced downwardly from the lid aperture 35 and accordingly is not visible through this lid aperture 35 with the tamper-evident member 40 in this first lower position.

The bore seal 33 provided within the lid 30 is shown pressed against the dispensing member 82 to thereby seal it.

Further, a retaining member 37 is indicated lying radially between the bore seal 33 and the outer skirt of the lid 30. This retaining member 37 projects downwardly from the underside of the lid 30 but does not reach all the way to the deck 22 of the skirt 20 such that it leaves an aperture 110 (refer to FIG. 5). This aperture 110 is presently masked by the presence of the tamper-evident member 40 and the grasping portion 50 thereof.

Provided on the radially outer surface of this retaining member 37 is a projection 38. This projection has a sloping lower surface and a horizontal upper surface. The sloping lower surface 38 allows the tamper evident member 40, and in particular the block 54, to travel past it from a lower, primed position to an upper position. With the tamper-evident member 40 in the first position, as shown in FIG. 4, the projection 38 projects radially outwardly and in to the recess 53 on the tamper-evident member 40. The interaction of the upper surface of the projection 38 and the top of the recess 53 prevents the lid 30 from being opened without the frangible bridge(s) 51 breaking and the tamper-evident member 40 moving upwardly with the lid 30.

In one embodiment, the closure 10 is molded in the open position, as shown in FIG. 3. This means that upon initial assembly the lid 30 is moved to the initially closed position as shown in FIG. 1. Accordingly, the tamper-evident member 40 slides upwardly between the retaining member 37 and the outer skirt of the lid 30 so that the projection 38 on the retaining member 37 passes into the recess 53 such that the tamper-evident member 40 becomes primed.

In use, a user grasps the grasping portion 50 aided by the recess 25 and applies upward axial force to it in an attempt to open the lid 30. By the application of this force, the tamper-evident 40 is moved axially upward within the pocket formed between the retaining member 37 and the outer skirt of the lid 30. This is shown in FIG. 5.

Figure 5:
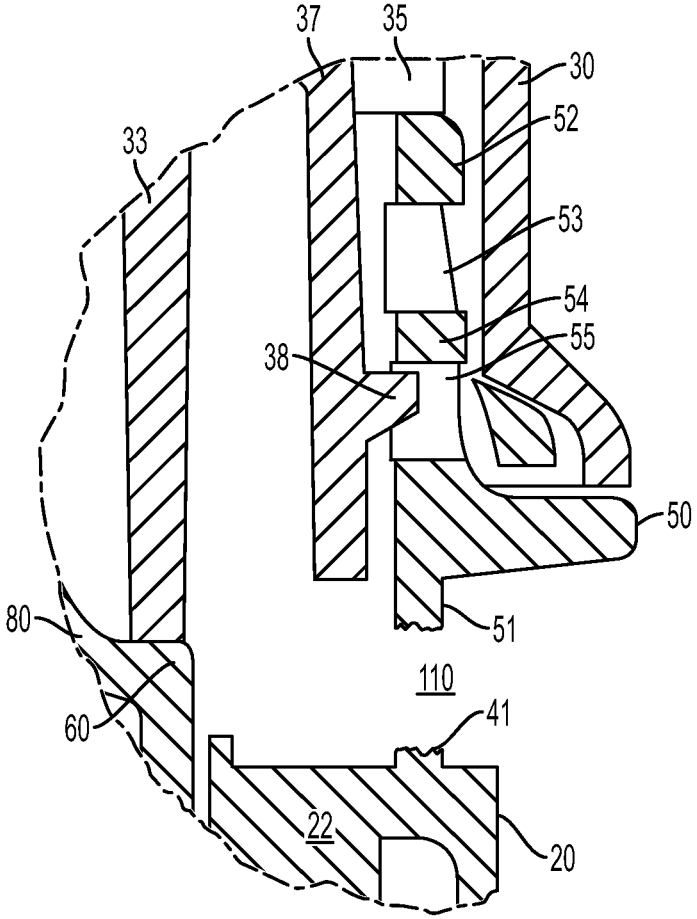
FIG. 5 is an elevational cross-section of part of the closure of FIG. 2.

In FIG. 5 the tamper-evident member 40 is shown having moved axially upwards from its first position to its second position such that the projection 38 has moved from recess 53 to recess 55 past intermediate block 54. The tamper-evident member 40 is prevented from returning to its first position by the block 54 which cannot pass back beyond the projection 38 due to the corresponding horizontal surfaces provided on the upper surface of the projection 38 and the underside of the block 54. The projection 38 now rests in the lower recess 55. The frangible bridge 51 accordingly has broken leaving behind a mark or portion of the frangible bridge 41 on the deck 22 of the base 20.

By the movement of the tamper-evident member 40 to its second raised or upper position an aperture 110 is exposed between the lower end of the retaining member 37 and the deck 22 of the base 20. A user may see a portion 60 of the dispensing member 80 through this aperture 110.

The invention claimed is:

1. A tamper-evident closure comprising:

(a) a base;

(b) a lid; and (c) a tamper-evident member irreversibly movable between a first position in which part of said tamper-evident member is visible prior to initial opening of said tamper-evident closure and a second position in which said part is masked by said lid so as to be at least partly hidden from view, said tamper-evident member being moved from said first position to said second position upon initial opening of said tamper-evident closure;

said closure further comprising first retaining means for retaining said tamper-evident member in said first position; and said closure further including second retaining means for retaining said tamper-evident member in said second position;

wherein said first retaining means comprises at least one frangible bridge connecting said tamper-evident member to at least one of said base and said lid;

wherein said second retaining means comprises a first projection on said lid and a first recess in said tamper-evident member;

wherein said tamper-evident member includes a grasping portion for aiding the movement of said tamper-evident member from said first position to said second position; and wherein said grasping portion projects radially outwards from the perimeter of said lid.

2. The tamper-evident closure according to claim 1, wherein said closure further comprises third retaining means for retaining said lid in an initially closed position.

3. The tamper-evident closure according to claim 2, wherein said third retaining means comprises a second projection on said lid and a second recess in said tamper-evident member.

4. The tamper-evident closure according to claim 3, wherein said first and said second projections are the same.

5. The tamper-evident closure according to claim 1, further including a dispensing member substantially hidden from view by said tamper-evident member with said tamper-evident member in said first position, wherein at least part of said dispensing member is revealed with said tamper-evident member in said second position.

6. The tamper-evident closure according to claim 5, wherein said dispensing member is a spout.

7. The tamper-evident closure according to claim 5, wherein said dispensing member is a different color from said lid and said base.

8. The tamper-evident closure according to claim 1, further including a hinge for allowing said lid to move with respect to said base between an open position and a closed position.

9. The tamper-evident closure according to claim 8, wherein said lid, said base and said hinge are molded unitarily.

10. The tamper-evident closure according to claim 1, wherein said lid further comprises an aperture through which said tamper-evident member is visible with said tamper-evident member in said second position.

11. The tamper-evident closure according to claim 10, wherein said aperture is provided in the top of said lid.

12. A tamper-evident closure comprising:

(a) a base;

(b) a lid;

(c) a tamper-evident member irreversibly movable between a first position and a second position, the tamper-evident member including at least one of a first part and a second part, wherein the first part is visible in the first position prior to initial opening of said tamper-evident closure and is masked by said lid so as to be at least partly hidden from view in the second position, and wherein the second part is masked by said lid in the first position prior to initial opening of said tamper-evident closure and is visible in the second position via an opening in said lid, and wherein said tamper-evident member is moved from said first position to said second position upon initial opening of said tamper-evident closure;

wherein said lid further comprises an aperture through which said tamper-evident member is visible with said tamper-evident member in said second position;

wherein said aperture is provided in the top of said lid.

13. The tamper-evident closure according to claim 12, wherein said tamper-evident closure further comprises:

(a) first retaining means for retaining said tamper-evident member in said first position, and wherein said first retaining means further comprises at least one frangible bridge connecting said tamper-evident member to at least one of said base and said lid;

(b) second retaining means for retaining said tamper-evident member in said second position, and wherein said second retaining means further comprises:

(i) a first projection on said lid; and (ii) a first recess in said tamper-evident member;

(c) a hinge for allowing said lid to move with respect to said base between an open position and a closed position; and (d) third retaining means for retaining said lid in an initially closed position, and wherein said third retaining means further comprises:

(i) a second projection on said lid; and (ii) a second recess in said tamper-evident member.

14. The tamper-evident closure according to claim 12, wherein said tamper-evident member further comprises:

(a) a grasping portion for aiding the movement of said tamper-evident member from said first position to said second position, and wherein said grasping portion projects radially outwards from the perimeter of said lid; and (b) a dispensing member substantially hidden from view by said tamper-evident member with said tamper-evident member in said first position, wherein at least part of said dispensing member is revealed with said tamper-evident member in said second position.

15. A tamper-evident closure comprising:

(a) a base;

(b) a lid; and (c) a tamper-evident member irreversibly movable between a first position in which apart of said tamper-evident member is masked by said lid prior to initial opening of said tamper-evident closure and a second position in which said part of said tamper-evident member is visible via an opening in said lid, said tamper-evident member being moved from said first position to said second position upon initial opening of said tamper-evident closure;

(d) first retaining means for retaining said tamper-evident member in said first position, and wherein said first retaining means further comprises at least one frangible bridge connecting said tamper-evident member to at least one of said base and said lid; and (e) second retaining means for retaining said tamper-evident member in said second position, and wherein said second retaining means further comprises:

(i) a first projection on said lid; and (ii) a first recess in said tamper-evident member; and (f) third retaining means for retaining said lid in an initially closed position, and wherein said third retaining means further comprises:

(i) a second projection on said lid; and (ii) a second recess in said tamper-evident member.

16. The tamper-evident closure of claim 1, wherein said part of the tamper-evident member is a first part, wherein said tamper-evident member further comprises a second part, wherein in the first position, said first part is visible and said second part is masked by said lid, and wherein in the second position, said first part is masked by said lid and said second part is visible via an opening in said lid.

17. A tamper-evident closure comprising:

(a) a base;

(b) a lid; and (c) a tamper-evident member irreversibly movable between a first position in which part of said tamper-evident member is visible prior to initial opening of said tamper-evident closure and a second position in which said part is masked by said lid so as to be at least partly hidden from view, said tamper-evident member being moved from said first position to said second position upon initial opening of said tamper-evident closure;

said closure further comprising first retaining means for retaining said tamper-evident member in said first position;

said closure further including second retaining means for retaining said tamper-evident member in said second position; and said closure further including a dispensing member substantially hidden from view by said tamper-evident member with said tamper-evident member in said first position, wherein at least part of said dispensing member is revealed with said tamper-evident member in said second position;

wherein said first retaining means comprises at least one frangible bridge connecting said tamper-evident member to at least one of said base and said lid;

wherein said second retaining means comprises a first projection on said lid and a first recess in said tamper-evident member.

* * * * *

UNITED STATES PATENT AND TRADEMARK OFFICE

CERTIFICATE OF CORRECTION

PATENT NO. : 8,490,804 B2
APPLICATION NO. : 12/740939
DATED : July 23, 2013
INVENTOR(S) : Benoit-Gonin et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 383 days.

Signed and Sealed this
Eighth Day of September, 2015

Michelle K. Lee

Michelle K. Lee
*Director of the United States Patent and Trademark Office*